US006196539B1

(12) United States Patent
Lee

(10) Patent No.: US 6,196,539 B1
(45) Date of Patent: Mar. 6, 2001

(54) CONVENIENTLY OPERATED SHEET-HANDLING DEVICE

(75) Inventor: Paul Lee, Sin-Dien (TW)

(73) Assignee: Ultima Electronics Corp., Taipei Hsien (TW)

( * ) Notice: Subject to any disclaimer, the term of this patent is extended or adjusted under 35 U.S.C. 154(b) by 0 days.

(21) Appl. No.: 09/391,332

(22) Filed: Sep. 7, 1999

(51) Int. Cl.[7] ..... B65H 1/00
(52) U.S. Cl. ..... 271/171
(58) Field of Search ..... 271/171

(56) References Cited

U.S. PATENT DOCUMENTS 4,786,042 * 11/1988 Stemmle ..... 271/171 X
5,172,903 * 12/1992 Haneda et al. ..... 271/171

FOREIGN PATENT DOCUMENTS 57-31642 * 8/1982 (JP) ..... 271/171
3166129 * 7/1991 (JP) ..... 271/171
3186529 * 8/1991 (JP) ..... 271/171

* cited by examiner

*Primary Examiner*—David H. Bollinger
(74) *Attorney, Agent, or Firm*—Ladas & Parry

(57) ABSTRACT

A sheet-handling device includes a tray, two edge guides, an extensile plate and a linkage mechanism. The edge guides and the extensile plate are movably connected to the tray. The linkage mechanism is connected to the edge guides and the extensile plate. When the edge guides or the extensile plate is moved, other components are forced to move via the linkage mechanism.

4 Claims, 6 Drawing Sheets

CONVENIENTLY OPERATED SHEET-HANDLING DEVICE

BACKGROUND OF THE INVENTION

1. Field of the Invention

The present invention relates in general to a conveniently operated sheet-handling device.

2. Description of the Related Art

Referring to FIG. 1, a conventional sheet-handling device 10 such as a printer, a fax machine or a scanner has a tray 13 for supporting paper sheets 19. On the tray 13 are provided two recesses 135, while edge guides 15 are movably provided in the recesses 135. The edge guides 15 are arranged on both sides of the paper sheets 19 to keep the paper sheets 19 in the correct position during the paper-feeding process. Thus, the paper sheets 19 do not get stuck in the sheet-handling device 10. The sheet-handling device is adjusted for large paper sheets by moving the edge guides 15 in the directions E and F. Furthermore, an extensile plate 17 is mounted in the tray 13. The extensile plate 17 can be stretched from the tray 13 in the direction D to support the paper sheets 19, thereby preventing the paper sheets 19 from drooping.

It is noted that the movements of the two edge guides 15 are synchronous. However, the movement of the extensile plate 17 is independent from those of the edge guides 15. In operation, the movement of the edge guides 15 to keep the paper sheets in the correct position and the movement of the extensile plate 17 to support the paper sheets are separate. Thus, the operation is not convenient.

SUMMARY OF THE INVENTION

An object of the present invention is to provide a sheet-handling device, the operation of which is convenient.

Another object of the present invention is to provide a sheet-handling device, for which the movements of the edge guides and the extensile plate are synchronous.

The sheet-handling device of the present invention includes a tray, two edge guides, an extensile plate and a linkage mechanism. The edge guides and the extensile plate are movably connected to the tray. The linkage mechanism is connected to the edge guides and the extensile plate. When one of the edge guides and the extensile plate is moved, other components are forced to move via the linkage mechanism.

In sum, the present invention provides a linkage mechanism to synchronously move the edge guides and the extensile plate so that the device can be conveniently operated.

BRIEF DESCRIPTION OF THE DRAWINGS

The present invention can be more fully understood by reading the subsequent detailed description and examples with references made to the accompanying drawings, wherein.

DETAILED DESCRIPTION OF THE PREFERRED EMBODIMENT

Figure 1:
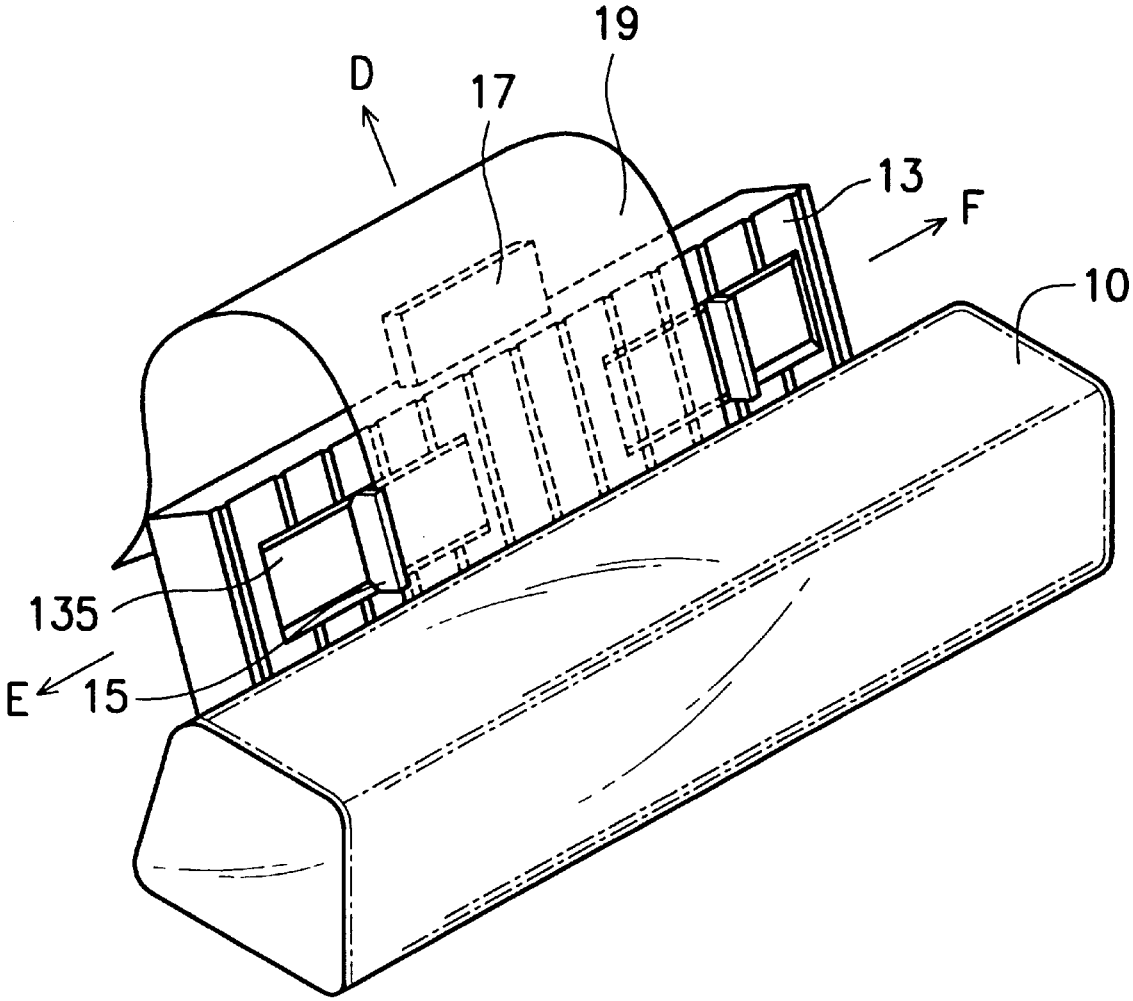
FIG. 1 (PRIOR ART)
FIG. 1 is a perspective diagram of a conventional sheet-handling device.
Figure 2:
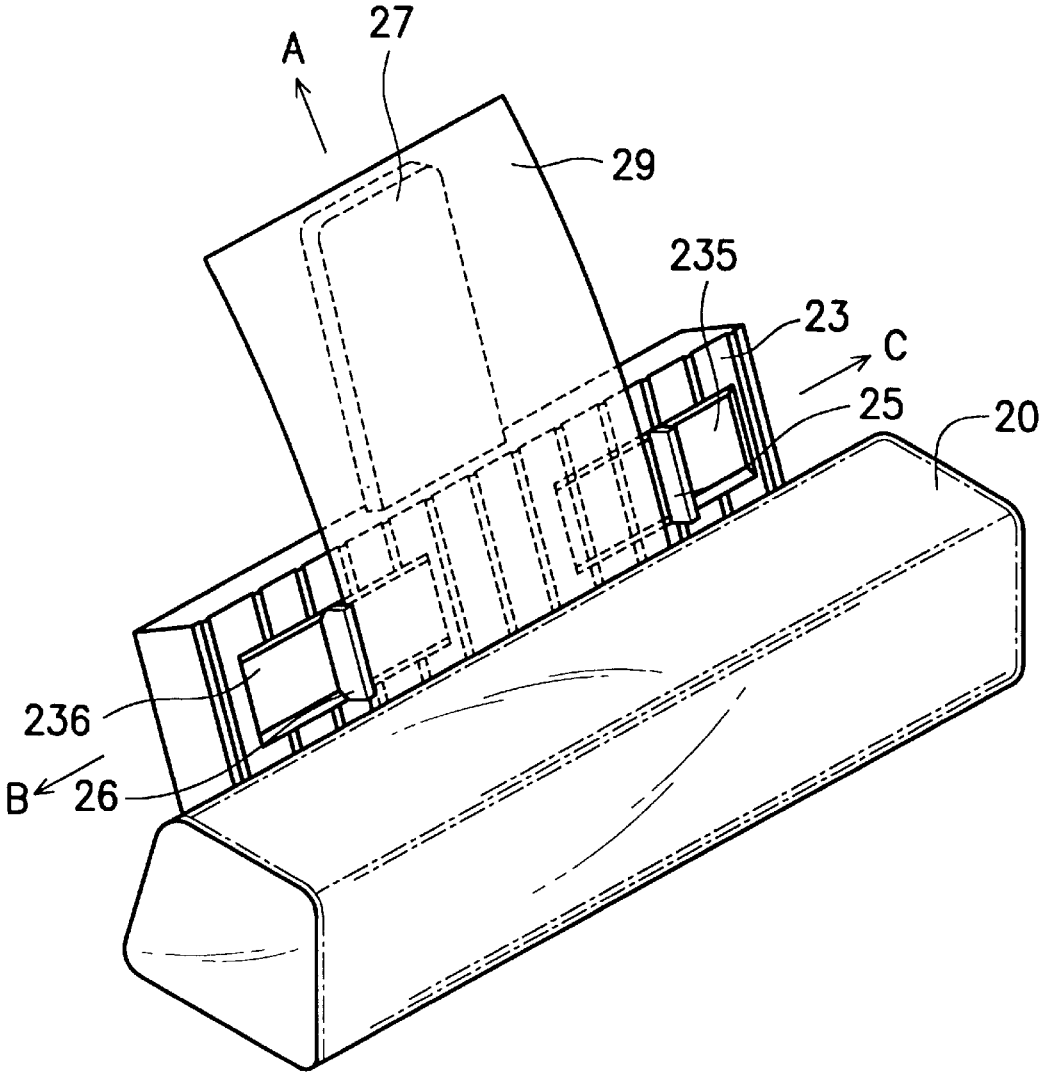
FIG. 2 is a perspective diagram of a sheet-handling device in accordance with the present invention.
Figure 3A:
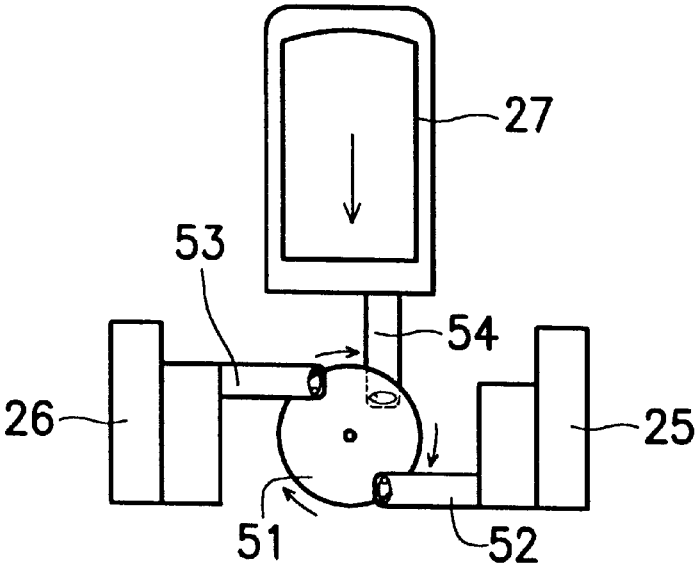
FIG. 3A is a schematic diagram of a linkage mechanism in accordance with a first embodiment of the present invention, in which the edge guides and the extensile plate are moved away from each other.
Figure 3C:
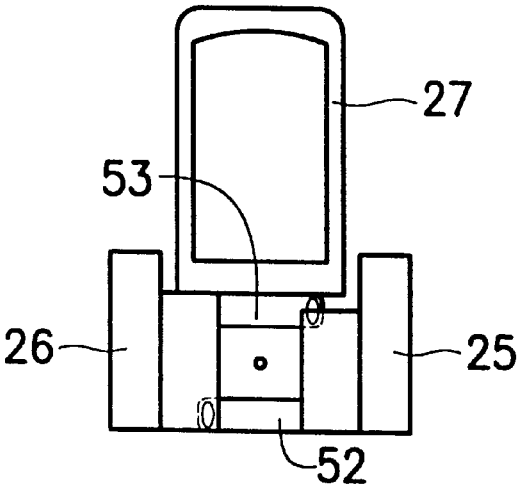
FIG. 3C is a schematic diagram of a linkage mechanism in accordance with the first embodiment of the present invention, in which the edge guides and the extensile plate are moved close to each other.
Figure 3B:
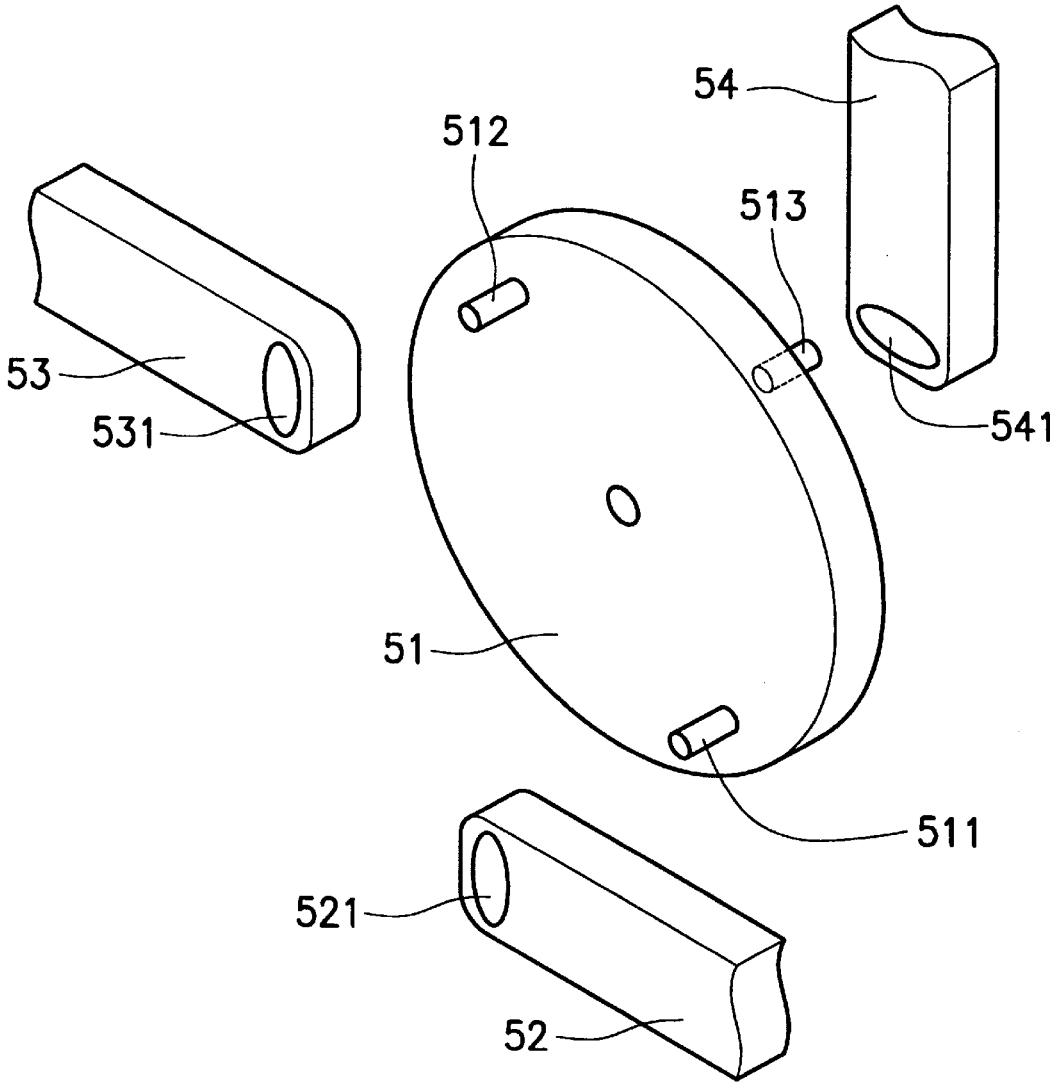
FIG. 3B is a locally enlarged diagram of FIG. 3A, in which the rods and the wheel are exploded.

Referring to FIG. 2, a sheet-handling device 20 of the present invention has a tray 23 for supporting paper sheets 29. On the tray 23 are provided two recesses 235, 236 while edge guides 25, 26 are movably provided in the recesses 235, 236. The edge guides 25, 26 are arranged on both sides of the paper sheets 29 to keep the paper sheets 29 in the correct position during the paper-feeding process. Thus, the paper sheets 29 do not get stuck in the sheet-handling device 20. The sheet-handling device is adjusted for large paper sheets by moving the edge guides 25, 26 in the directions B and C. Furthermore, an extensile plate 27 is mounted in the tray 23. The extensile plate 27 can be stretched from the tray 23 in the direction A to support the paper sheets 29, thus preventing the paper sheets 29 from drooping. It is noted that in the present invention the movements of the edge guides 25, 26 and the extensile plate 27 are synchronous. That is, the extensile plate 27 moves in the direction A, when the edge guides 25, 26 are moved by the user in the directions B and C. The edge guides 25, 26 and the extensile plate 27 are synchronously moved by a linkage mechanism mounted in the tray 23. The linkage mechanism is described as follows:

Referring to FIGS. 3A, 3B and 3C, the linkage mechanism of a first embodiment of the present invention include a wheel 51 and three rods 52, 53, 54. The wheel 51 has a first surface and a second surface. Two pins 511, 512 are connected to the first surface while a pin 513 is connected to the second surface. The rods 52, 53, 54 have slots 521, 531, 541 at their ends, respectively. The rod 52 is firmly fixed to the edge guide 25 while the pin 511 is movably received in the slot 521 of the rod 52. The rod 53 is firmly fixed to the edge guide 26 while the pin 512 is movably received in the slot 531 of the rod 53. The rod 54 is firmly fixed to the extensile plate 27 while the pin 513 is movably received in the slot 541 of the rod 54. When the user moves one of the edge guides 25, 26, the wheel 51 is rotated. The rotation of the wheel 51 forces the extensile plate 27 to move vertically. Meanwhile, the two edge guides 25, 26 are moved close to or away from each other. By this arrangement, the movements of the edge guides 25, 26 and the extensile plate 27 are synchronous, thus reducing the number of steps of the operation.

Figure 4A:
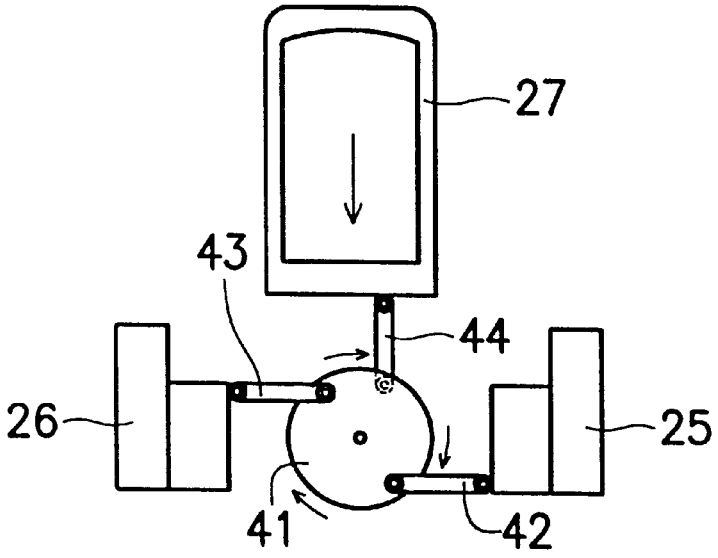
FIG. 4A is a schematic diagram of a linkage mechanism in accordance with a second embodiment of the present invention, in which the edge guides and the extensile plate are moved away from each other.
Figure 4B:
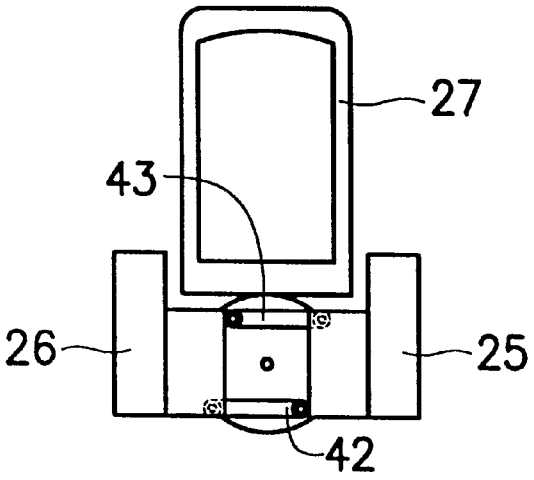
FIG. 4B is a schematic diagram of a linkage mechanism in accordance with the second embodiment of the present invention, in which the edge guides and the extensile plate are moved close to each other.

Referring to FIGS. 4A and 4B, the linkage mechanism of a second embodiment of the present invention include a wheel 41 and three rods 42, 43, 44. The wheel 41 has a first surface and a second surface. The rod 42 is hinged to the edge guide 25 and the first surface of the wheel 41. The rod 43 is hinged to the edge guide 25 and the first surface of the wheel 41. The rod 44 is hinged to the extensile plate 27 and the second surface of the wheel 41. When the user moves one of the edge guides 25, 26, the toothed wheel 41 is rotated. The rotation of the toothed wheel 41 forces the extensile plate 27 to move vertically. Meanwhile, the two edge guides 25, 26 are moved close to or away from each other.

Figure 5A:
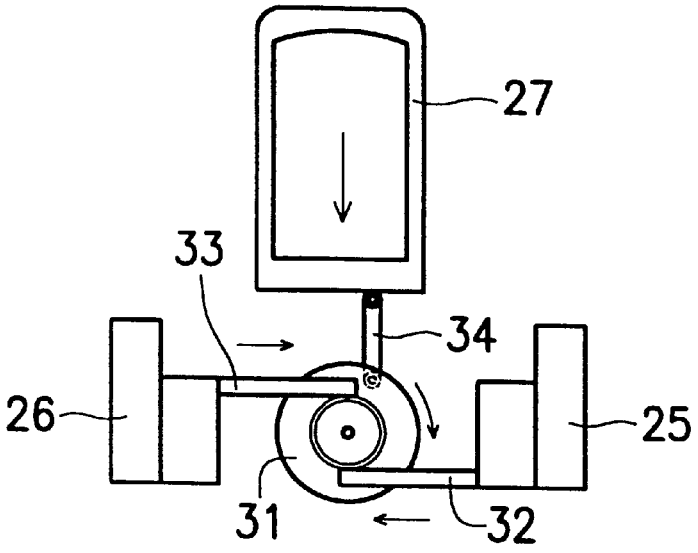
FIG. 5A is a schematic diagram of a linkage mechanism in accordance with a third embodiment of the present invention, in which the edge guides and the extensile plate are moved away from each other.
Figure 5B:
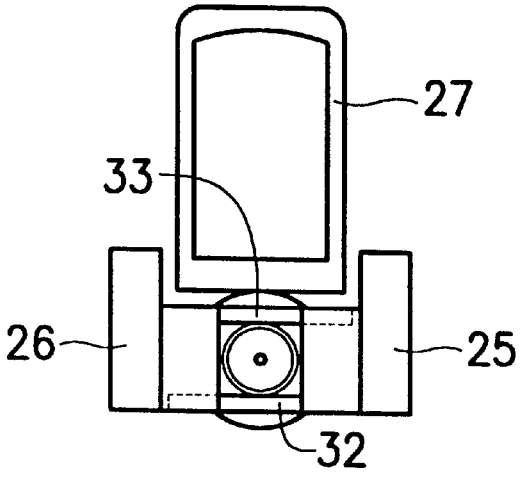
FIG. 5B is a schematic diagram of a linkage mechanism in accordance with the third embodiment of the present invention, in which the edge guides and the extensile plate are moved close to each other.

Referring to FIGS. 5A and 5B, the linkage mechanism of a third embodiment of the present invention include a toothed wheel 31, two racks 32, 33 and a rod 34. The wheel 31 has a first surface, on which teeth are provided, and a second surface. The racks 32, 33 engage the teeth on the first surface of the toothed wheel 31 while ends of the racks 32, 33 are firmly fixed to the edge guides 25, 26. Furthermore, the ends of the rod 34 are hinged to the second surface of the toothed wheel 31 and the extensile plate 27, respectively. When the user moves one of the edge guides 25, 26, the toothed wheel 31 is rotated. The rotation of the toothed wheel 31 forces the extensile plate 27 to move vertically. Meanwhile, the two edge guides 25, 26 are moved close to or away from each other.

In conclusion, the present invention provides a linkage mechanism to synchronously move the edge guides 25, 26 and the extensile plate 27 so that the device can be conveniently operated.

While the invention has been described by way of example and in terms of the preferred embodiment, it is to be understood that the invention is not limited to the disclosed embodiments. To the contrary, it is intended to cover various modifications and similar arrangements (as would be apparent to those skilled in the art) . Therefore, the scope of the appended claims should be accorded the broadest interpretation so as to encompass all such modifications and similar arrangements.

What is claimed is:

1. A sheet-handling device, including:

a tray;

a first edge guide movably connected to the tray;

an extensile plate movably connected to the tray;

a linkage mechanism connected to the first edge guide and the extensile plate, wherein, when the first edge guide is moved, the extensile plate is forced to move by the first edge guide via the linkage mechanism, and when the extensile plate is moved, the first edge guide is forced to move by the extensile plate via the linkage mechanism; and, a second edge guide connected to the linkage mechanism, by which the second edge guide is also moved when the first edge guide or the extensile plate is moved, wherein the linkage mechanism includes:

a wheel having a first surface and a second surface;

a first rod having a first end movably connected to the first surface of the wheel and a second end firmly fixed to the first edge guide;

a second rod having a third end movably connected to the first surface of the wheel and a fourth end firmly fixed to the second edge guide; and a third rod having a fifth end movably connected to the second surface of the wheel and a sixth end firmly fixed to the extensile plate.

2. A sheet-handling device as claimed in claim 1, wherein the linkage mechanism further includes a first pin and a second pin attached to the first surface and a third pin attached to the second surface; the first end of the first rod has a first slot provided thereon to receive the first pin; the third end of the second rod has a second slot provided thereon to receive the second pin; and the fifth end of the third rod has a third slot provided thereon to receive the third pin.

3. A sheet-handling device, including:

a tray;

a first edge guide movably connected to the tray;

an extensile plate movably connected to the tray;

a linkage mechanism connected to the first edge guide and the extensile plate, wherein, when the first edge Guide is moved, the extensile plate is forced to move by the first edge guide via the linkage mechanism, and when the extensile plate is moved, the first edge guide is forced to move by the extensile plate via the linkage mechanism; and, a second edge guide connected to the linkage mechanism, by which the second edge guide is also moved when the first edge guide or the extensile plate is moved, wherein the linkage mechanism includes:

a wheel having a first surface and a second surface;

a first rod hinged to the first surface of the wheel and the first edge guide;

a second rod hinged to the first surface of the wheel and the second edge guide; and a third rod hinged to the second surface of the wheel and the extensile plate.

4. A sheet-handling device, including:

a tray;

a first edge guide movably connected to the tray;

an extensile plate movably connected to the tray;

a linkage mechanism connected to the first edge guide and the extensile plate, wherein, when the first edge guide is moved, the extensile plate is forced to move by the first edge guide via the linkage mechanism, and when the extensile plate is moved, the first edge guide is forced to move by the extensile plate via the linkage mechanism; and, a second edge guide connected to the linkage mechanism, by which the second edge guide is also moved when the first edge guide or the extensile plate is moved, wherein the linkage mechanism includes:

a wheel having a first surface, a second surface and teeth provided on the first surface;

a first rack engaging the teeth and being firmly fixed to the first edge guide;

a second rack engaging the teeth and being firmly fixed to the second edge guide; and a rod hinged to the second surface of the wheel and the extensile plate.

* * * * *